United States Patent [19]

Brint

[11] Patent Number: 4,739,571

[45] Date of Patent: Apr. 26, 1988

[54] FIRING MECHANISM

[76] Inventor: Norman T. Brint, 4 The Cobbins, Waltham Abbey, Essex EN9 1LH, United Kingdom

[21] Appl. No.: 796,023

[22] PCT Filed: Mar. 26, 1985

[86] PCT No.: PCT/GB85/00115

§ 371 Date: Oct. 29, 1985

§ 102(e) Date: Oct. 29, 1985

[87] PCT Pub. No.: WO85/04471

PCT Pub. Date: Oct. 10, 1985

[30] Foreign Application Priority Data

Mar. 26, 1984 [GB] United Kingdom ..... 8407743

[51] Int. Cl.[4] ..... F41C 19/00; F41C 11/00

[52] U.S. Cl. ..... 42/69.02; 42/16; 89/189

[58] Field of Search ..... 42/16, 18, 69.02; 89/168, 175, 189

[56] References Cited

U.S. PATENT DOCUMENTS 4,387,524 6/1983 Brint et al. ..... 42/69.02 X
4,471,549 9/1984 Brint et al. ..... 42/18 X

FOREIGN PATENT DOCUMENTS 65621 6/1891 Fed. Rep. of Germany .
363148 7/1906 France .
4126 of 1906 United Kingdom .

*Primary Examiner*—Ted L. Parr
*Attorney, Agent, or Firm*—Watson, Cole, Grindle & Watson

[57] ABSTRACT

A firing mechanism having a trigger operated breech block. A crank, connected between the trigger and the breech block, has a first camming surface for moving the breech block forwardly and locking it in a firing position, and a second camming surface for cocking and releasing the firing pin during the breech block's forward movement.

5 Claims, 1 Drawing Sheet

FIRING MECHANISM

TECHNICAL FIELD

The present invention relates to a firing mechanism and to a method of, and means for, manipulating a round of ammunition.

BACKGROUND ART

British Patent Application No. 2081429A discloses a firearm for discharge of rounds such as gas canisters and the like. The firearm comprises a body in which there is a cavity for a round of ammunition with a percussion detonating means in a rearward facing surface thereof, at least one transverse aperture for introduction of a round into the cavity and ejection of the round therefrom, a breech block rearward of the cavity and movable to and from a rest disposition to a firing disposition forward of the rest disposition to carry the front of the round forwardly into engagement with a seating at the forward end of the cavity, and a firing pin carried by the breech block with a forward end to impact with the detonating means for detonation and discharge of the round, and a trigger to actuate the movement of the breech block and the firing pin, the firing mechanism comprising means to transmit the trigger movement to the breech block and lock the breech block in the firing disposition.

The prior published application discloses, in particular, an actuating mechanism for a firearm of this type in which use is made of an over-centre toggle linkage to lock the breech block in the firing disposition, and a sear mounted in the body of the firearm for holding and release of the firing pin upon movement of the trigger.

SUMMARY OF THE INVENTION

It is a continuing need in the design of firearms that the number of moving parts should be reduced to a minimum and that the interaction of these parts should be reliable and simple. It is one object of the present invention to satisfy this need rather better than does the previous proposal.

Accordingly, a first aspect of the present invention provides a firing mechanism as described above and characterised by camming means caused to move from a rest disposition to a firing disposition by movement of the trigger, the camming means having a first camming surface which contacts a cammed surface on the breech block to urge the breech block from its rest disposition to its firing disposition and lock the block in the firing disposition until the trigger moves out of its firing disposition, and a second camming surface which contacts a cammed surface on the firing pin during movement of the camming means from its rest disposition to its firing disposition to restrain forward travel of the firing pin during the movement yet allow such forward movement, for actuation of the detonating means, once the breech block is locked in the firing disposition. In accordance with a second aspect of the present invention there is provided a method of introducing a round of ammunition into the cavity of a firearm as described above and allowing ejection of the round therefrom, after firing, the method comprising the steps of:

(i) providing a first pair and a second pair of cooperating engagement surfaces, a static member of each pair being provided on the rear face of the round, and a moving element of each pair being provided on the front face of the breech block, the first pair of surfaces constituting a latch, and engaging when the round is introduced into the cavity with the breech block in its rest disposition to restrain the round from movement out of the cavity, and the second pair constituting a locking means for restraining lateral movement of the rear end of the round when the round is in its forward firing disposition;

(ii) spacing the two moving members apart from one another laterally in the breech block by a distance which is different from that separating the two static engagement surfaces in the rear face of the round;

(iii) so shaping the engagement surfaces that, when the breech block is moved forwardly from its rest disposition to its firing disposition, the static and moving members of the second pair engage one another, despite the noted difference in lateral spacing;

(iv) withdrawing the moving surface of the first pair from engagement with the corresponding static surface during the period when the breech block moves from its rest disposition, forward to its firing disposition; and (v) withdrawing the moving surface of the second pair from its corresponding static surface during rearward movement of the breech block, and so shaping the engagement surfaces of the first pair, that their re-engagement does not take place during said rearward travel of the breech block, whereby, upon return of the breech block and fired round to the rest disposition, after firing, neither the first nor the second pair of engagement surfaces is engaged, so permitting ejection of the round from the cavity upon its return to the rest disposition.

Also in accordance with the invention are means to carry this method into effect.

In one embodiment, the moving element of the first pair is a latch plunger and that of the second pair is a locking pin, the plunger and pin being located in parallel bores in the breech block. The required forward and rearward movements of the plunger and pin in the block are accomplished by a rocker pin pivotably mounted to the block at a pivotal axis and engaged with both the latch plunger and locking pin, one on each side of the pivotal axis. One end of the rocker pin is engaged with the body of the firearm in which the block slides.

For a better understanding of the present invention, and to show more clearly how the same may be carried into effect, reference will now be made, by way of example, to the accompanying drawings.

DETAILED DESCRIPTION OF THE PREFERRED EMBODIMENT

Figure 1:
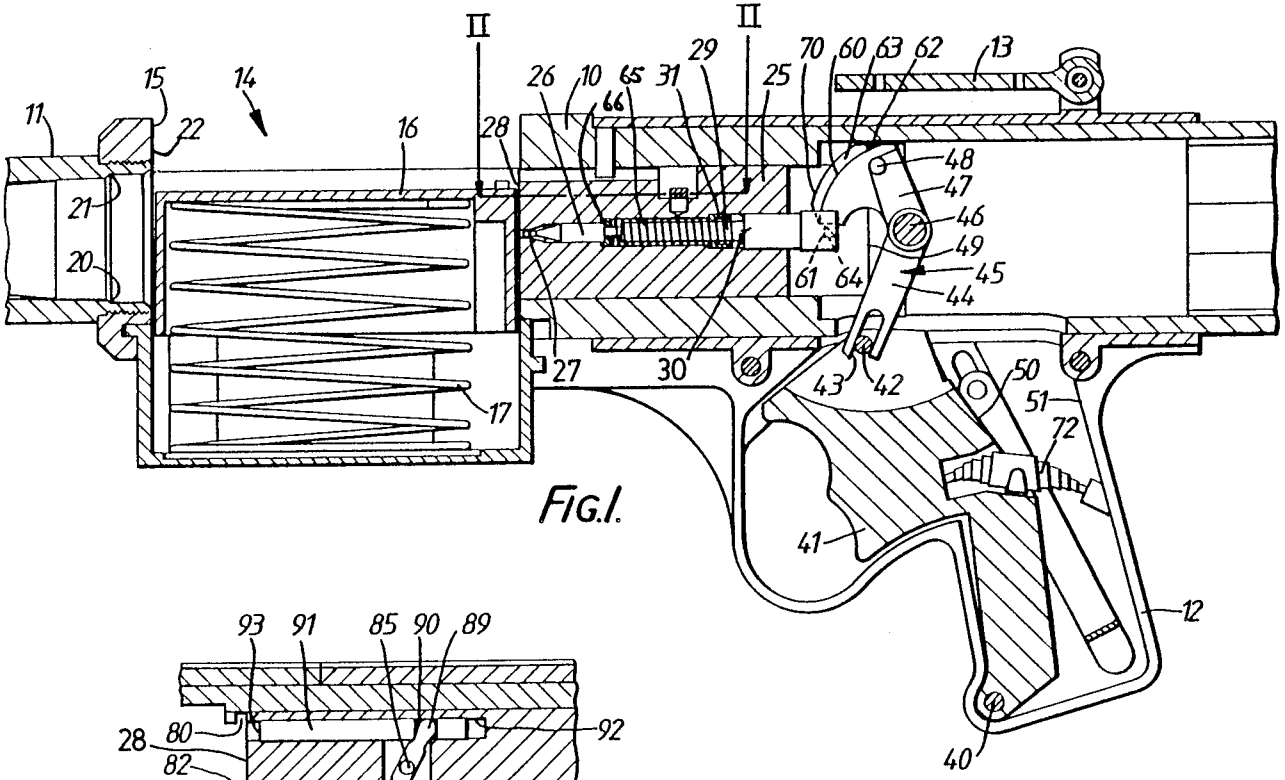
FIG. 1 is a longitudinal diametral vertical section of the breech of a hand-held firearm according to a preferred embodiment of the present invention and into which can be loaded single rounds of ammunition such as gas canisters.

The firearm comprises a body 10 having a barrel 11, a trigger guard 12 and a rear sight 13. Single rounds of ammunition (not shown) are loaded into a cavity 14 through an aperture 15, such action depressing a platform 16 which is resiliently biased into the cavity 14 from below by a compression spring 17, the platform 16 and spring 17 serving to eject the round after it has been fired, as will be explained below.

At the rear end of the barrel 11, just forward of the forward edge of the cavity 14, is a seating 20, the forward edge of which is delineated by a shoulder 21, which receives the front end of the round when it is in its firing disposition. Thus, the round, prior to firing, moves in the cavity 14 from a rest disposition in which its front edge is at the front edge 22 of the cavity 14 to a firing disposition in which its front edge is at the shoulder 21.

This forward movement is brought about by forward sliding movement of a breech block 25 rearward of the cavity 14. The block 25 carries a firing pin 26 which has a hardened tip 27 at its front end which normally lies rearwardly of the forward facing end surface 28 of the block 25 but which can slide in the block 25 sufficiently far forward for the tip 27 to impact with a percussion detonating means on the rear face of the round in contact with the front face 28 of the block 25. Such forward movement of the pin 26 relative to the block 25 is resiliently resisted by a helical spring 29 surrounding the firing pin and of which one end abuts a shoulder 30 on the firing pin and the other a shoulder on a bore insert 31 in the breech block.

Pivotally mounted at 40 on the body 10 is a trigger 41 which carries a fixed pin 42 in engagement with a slot 43 on one arm 44 of a bell crank 45 pivotally mounted to the body 10 at a pivot pin 46. The other arm 47 of the crank carries a fixed pin 48 which is in engagement with a transversely-extending slot 49 in the block 25. It will be seen that the action of squeezing the trigger 41 moves the pin 42 rearwardly and hence the pin 48 forwardly. This forward movement causes the pin 48 to slide along the front edge of the slot 49 and, if the trigger is pulled back far enough, the pin 48 moves to an over-centre position with respect to the pivot pin 46 such that a rearwardly-directed force applied to the breech block 25 (such as when a round is fired) will tend to drive the first arm 44 of the crank 45 further rearwardly, instead of forwardly. At this point in the movement of the firing mechanism, a rearward-facing surface 50 of the trigger is already in contact with a forward-facing surface 51 of the trigger guard 12, and so further rearward movement of the crank arm 44 is not possible. Thus, the over-centre disposition of the crank 45 serves to lock the breech block 25 in a forward firing disposition.

The second lever arm 47 of the bell crank camming means 45 has a second camming surface 60 which is rearward facing. This engages a forward-facing cammed surface 61 at the rear end of the firing pin 26. All points on the camming surface 60 are at the same radial distance from the pivotal axis 46 so that, as the camming means 45 rotates, the position of the firing pin 26 remains constant, despite the forward movement of the block 25. This relative movement has the effect of compressing a helical compression spring 65 between a collar 66 on the firing pin 26 and the bore insert 31.

The second camming surface 60 terminates abruptly at a release edge 62 which is colinear with the axis of each of the pins 46 and 48 so that, as the crank 45 goes over-centre, the firing pin 26 is released from the camming surface 60 to be urged forwardly by extension of the spring 65 for impact of the tip 27 with the detonating means of the round in the cavity 14. At impact, the spring 29 is compressed so, after impact, the head 27 of the pin 26 is brought back by the spring 29 to a position rearward of the front face 28 of the block 25.

As the trigger is released, and moves from the firing disposition to the rest disposition, the crank 45 rotates clockwise as seen in the drawing. Provision is made for allowing the arcuate structure 63 on which is the camming surface 60, and the post 64 on which is the cammed surface 61 on the firing pin, to move across their respective lines of action to resume the relative positions shown in FIG. 1. This is accomplished by a camming movement of a forward-facing surface 70 on the arcuate structure 63 along a rearward-facing cammed surface on the post 64, to the rear of the surface 61 cammed by camming surface 60. During the course of the clockwise rotation of the crank 45, the pin 26 is urged forwardly to some extent by this cam action, and the housing of the pin 26 within the block 25 is shaped with sufficient spacing as to allow this to happen. Further, the spring 29 between these two components is compressed by such relative movement and the action of the compressed spring is available to drive the firing pin 26 rearwardly into the position shown in FIG. 1 after the camming surface 70 has passed clear of the firing pin.

It will be appreciated that the usual bias 72 of the trigger from its firing disposition to its rest disposition is provided, and it is this bias which brings the crank and breech block back from the firing disposition to their rest dispositions. It will further be appreciated that the use of the bell crank camming means 45 yields the important advantage that there is only one intermediate moving part between, on the one hand, the trigger 41 and, on the other hand, the breech block 25 and firing pin 26.

Figure 2:
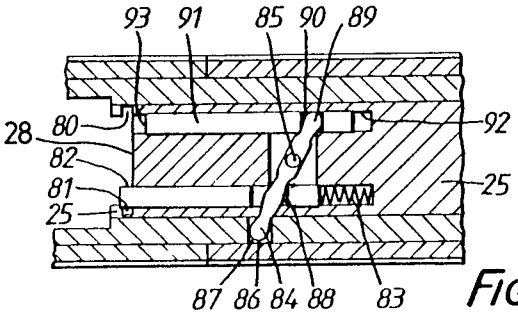
FIG. 2 is a fragmentary horizontal section of the weapon shown in FIG. 1, as seen along the line II—II in FIG. 1.

Turning now to FIG. 2, the breech block 25 is shown in its rest disposition and can be seen to define a forward face 28 which includes a righthand recess 80 and a lefthand recess 81, these two recesses serving to receive an annular ridge provided at the rear edge of the round of ammunition in the cavity 14. Preferably, the ammunition is rimless so that the ridge is within the cylindrical envelope of the round, but the ridge could be the rim of rimmed ammunition.

Thus, introduction of a round into the cavity 14 brings its ridge into engagement with the recesses 80 and 81. During such introduction a latch plunger 82, which is biased into a forward disposition as shown in FIG. 2 by a compression spring 83, is first of all pushed rearwardly by the edge of the round into its bore in the breech block but, once the round has fully entered the cavity 14, the latch plunger 82 engages with a corresponding recess in the rearward-facing surface of the round, thus retaining the round in the cavity 14 against the action of the ejector spring 17.

A rocker pin 84 is pivotally mounted on the breech block 25 by a pin 85. A first end 86 of the rocker pin 84 is received in a fixed recess 87 in the body 10 of the firearm. Between the end 86 and the pivot pin 85, the rocker pin 84 extends with clearance through a slot 88 in the latch plunger 82. The other end 89 of the rocker pin 84 is received in a slot 90 in a locking pin 91, which is slidable in a bore 92 in the breech block 25.

Thus, as the breech block 25 moves forward relative to the body 10, i.e., upon squeezing of the trigger 41, the rocker pin 84 pivots in a counterclockwise direction (in FIG. 2) until, at the firing disposition, the locking pin 91 has moved to a fully forward disposition, and the latch pin 82 has also moved forward relative to the body 10. However, contact between the rocker pin 84 and a rear edge of the slot 88 is effective to move the latch plunger rearward relative to the breech block 25 and the round with which it is engaged.

The round in the cavity 14 has a second recess in its rear end, which recess receives the forward end 93 of the locking pin 91. There is a difference between the lateral spacing of the two recesses in the rear end of the round and that between the latch 82 is and the locking pin 91, but the shape of the latch 82 such that the locking pin 91 freely engages with the corresponding second recess in the round during forward movement of the breech block, despite the difference in lateral spacing. By the time the breech block has reached the firing disposition, the latch plunger 82 has withdrawn rearwardly from its corresponding recess in the round, and restraint of lateral movement of the rear end of the round has passed from the latch plunger 82 to the locking pin 91.

As the breech block 25 moves from the forward firing disposition back to the rest disposition, the corresponding clockwise movement of the rocker pin 84 withdraws the locking pin 91 from its associated recess in the round. The difference in lateral spacing between the recesses in the round and the two pins in the breech block 25 is now, however, effective to prevent re-engagement of the latch plunger 82 in its recess. Accordingly, when the rest disposition is regained, neither the latch plunger 82 nor the latch pin 91 is in engagement with the round, and so it is free to be ejected from the cavity 14 by the spring 17 and platform 16. Upon such ejection the latch plunger 82 moves forward under the action of the biasing spring 83 for latching the next round to be loaded into the cavity 14.

The spring 17 is a square-section cylindrical coil spring but it could be some other form of spring, such as a leaf spring. The camming surface need not be an arc of a circle centred on the axis 46 but could be curved such as to draw the firing pin back rearwardly as the breech block moves forwardly. The second limb of the crank could be extended to form the trigger itself.

INDUSTRIAL APPLICABILITY

The term "ammunition" as used herein is to be understood not to be restricted to projectiles which are military projectiles but could include such projectiles as civilian distress flares.

I claim:

1. A firing mechanism for a firearm which comprises a body (10) in which there is a cavity (14) for a round of ammunition with a percussion detonating means in a rearward facing surface thereof, at least one transverse aperture (15) for introduction of a round into the cavity and ejection of the round therefrom, a breech block (25) rearward of the cavity and movable from a rest disposition to a firing disposition forward of the rest disposition to carry the front of the round forwardly into engagement with a seating (20) at the forward end of the cavity, a firing pin (26) carried by the breech block (25) with a forward end to impact with the detonating means for detonation and discharge of the round, and a trigger (41) to actuate the movement of the breech block and the firing pin, the firing mechanism comprising means to transmit the trigger movement to the breech block and lock the breech block in the firing disposition, and being characterised by camming means (45) caused to move from a rest disposition to a firing disposition by movement of the trigger (41), the camming means (45) having a first camming surface (48) which contacts a cammed surface (49) on the breech block (25) to urge the breech block from its rest disposition to its firing disposition and lock the block (25) in the firing disposition until the trigger (41) moves out of its firing disposition, and a second camming surface (60) which contacts a cammed surface (61) on the firing pin during movement of the camming means (45) from its rest disposition to its firing disposition to restrain forward travel of the firing pin during said movement yet allow such forward travel, for actuation of the detonating means, once the breech block (25) is locked in the firing disposition.

2. A firing mechanism as claimed in claim 1, wherein the camming means is provided as a two-limbed crank (45) pivotally mounted at a pivotal axis (46) to the body, and of which one limb (44) is engaged with the trigger (41) and the other limb (47) carries the first (48) and second (60) camming surfaces.

3. A firing mechanism as claimed in claim 2, wherein the first camming and cammed surfaces are in the form of a pin (48) and slot (49), arranged to go over-centre with respect to the line of movement of the breech block through the said pivotal axis (46) at the firing disposition whereby the reaction of the breech block on the crank upon firing the round imposes on the crank a force urging it to rotate further in the direction from the rest disposition to the firing disposition.

4. A firing mechanism as claimed in claim 3, wherein the second camming surface (60) has the form of an arc of a circle centred on the pivotal axis (46), the firing pin being energized, during the movement of the breech block forward, by a consequent tensioning of a spring (65) biasing means interposed between the firing pin and the breech block.

5. A firing mechanism as claimed in claim 1, wherein the firing pin is free to move forwardly relative to its rest position in the breech block, for movement of the second camming and cammed surfaces past each other as the breech block and camming means move from their respective firing dispositions to their rest dispositions.

* * * * *

UNITED STATES PATENT AND TRADEMARK OFFICE

CERTIFICATE OF CORRECTION

PATENT NO. : 4,739,571

DATED : April 26, 1988

INVENTOR(S) : Norman T. Brint

It is certified that error appears in the above-identified patent and that said Letters Patent is hereby corrected as shown below:

In column 5, line 8, after "latch 82" insert --is--.

Signed and Sealed this

Eleventh Day of October, 1988

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,739,571

DATED : April 26, 1988

INVENTOR(S) : Norman T. Brint

It is certified that error appears in the above-identified patent and that said Letters Patent is hereby corrected as shown below:

In column 5, line 8, after "latch 82" insert --is--.

Signed and Sealed this

Eighteenth Day of October, 1988

*Attest:*

DONALD J. QUIGG

*Attesting Officer*

*Commissioner of Patents and Trademarks*